US006808100B2

(12) United States Patent
Fielitz et al.

(10) Patent No.: US 6,808,100 B2
(45) Date of Patent: Oct. 26, 2004

(54) PORTABLE, COMBUSTION-ENGINED SETTING TOOL FOR FASTENING ELEMENTS

(75) Inventors: Harald Fielitz, Munich (DE); Johann Büchel, Sevelen (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/292,784

(22) Filed: Nov. 12, 2002

(65) Prior Publication Data

US 2003/0098328 A1 May 29, 2003

(30) Foreign Application Priority Data

Nov. 27, 2001 (DE) ..... 201 19 221 U

(51) Int. Cl.[7] ..... B25C 1/14
(52) U.S. Cl. ..... 227/10
(58) Field of Search ..... 227/9, 10, 11

(56) References Cited

U.S. PATENT DOCUMENTS 4,374,567 A * 2/1983 Combette et al. ..... 227/10
4,655,380 A * 4/1987 Haytayan ..... 227/9
5,048,740 A * 9/1991 Beton ..... 227/10
5,597,972 A * 1/1997 Wachter ..... 227/10
5,992,723 A * 11/1999 Lee ..... 227/9
6,029,878 A * 2/2000 Pfister et al. ..... 227/10
6,039,229 A * 3/2000 Pfister et al. ..... 227/10

* cited by examiner

*Primary Examiner*—Scott A. Smith
(74) *Attorney, Agent, or Firm*—Sidley Austin Brown & Wood, LLP

(57) ABSTRACT

A portable, combustion-engine setting tool for fastening elements and including a guide tube (1) for fastening elements (8), a piston rod (7) for driving fastening elements out of the guide tube (1), and a locking device for lockingly connecting the guide tube (1), with the tool base body (6) and including a locking nose (16) carried by the guide tube (1), a spring (16) for radially biasing the locking nose (16) away from the guide tube, with the locking nose (16) being manually radially displaceable toward the guide tube (1) against a biasing force of the spring (14) into a groove (22) provided in the base body (6).

10 Claims, 4 Drawing Sheets

PORTABLE, COMBUSTION-ENGINED SETTING TOOL FOR FASTENING ELEMENTS

BACKGROUND OF THE INVENTION

1. Field of the Invention

The present invention relates to a portable, combustion-engined setting tool for fastening elements and including a base body, a guide tube for fastening elements, a piston rod for driving fastening elements out of the guide tube, and a locking device for lockingly connecting the guide tube with the base body.

2. Description of the Prior Art

Setting tools of a type described above are generally known and can be formed, e.g., as explosive powder charge-actuated, bolt setting tool. With such setting tools, in accordance with the performed operation, i.e., in accordance with the accessibility of the treated location or the type of the set fastening elements, and for maintenance work, the guide tube should be capable of being quickly dismounted or mounted. When the mounting is effected by using a threaded connection, the guide tube should be capable of being stopped at a predetermined point to insure permanently a uniform piston stroke and thereby a uniform penetration depth of the fastening element.

Up to the present, a spring-biased, extending in the setting or longitudinal direction of the guide tube, pin, which was chamfered at one end, has been used. The pin, upon the guide tube reaching a predetermined screw-in depth during screwing of the guide tube into the tool base body, becomes engaged in a groove formed in the base body, preventing further screwing-in of the guide tube. For screwing the guide tube out of the base body, a torque dependent on the inclination angle of the pin and the applied biasing force, should have been overcome in order to withdraw the pin over its chamfer out of the groove to enable unscrewing of the guide tube.

The problem with such a pin, consists in that an unintentional unscrewing of the guide tube, as a result of rotation of the setting tool with the fixed guide tube, can take place, in particular during operation in a narrow space. This can lead to an inevitable damage of the setting tool. In addition, decrease of the biasing force, e.g., as result of fatigue or increase in contamination, directly influences the unscrewing torque, which further increase the danger of the setting tool being damaged.

Accordingly, an object of the present invention is a setting tool of a type described above which would insure a reliable operational process.

SUMMARY OF THE INVENTION

This and other objects of the present invention, which will become apparent hereinafter, are achieved by providing, in a setting tool of the type described above, a locking device including a locking nose carried by the guide tube, a spring for radially biasing the locking nose away from the guide tube with the locking nose being manually radially displaceable toward the guide tube against a biasing force of a spring into a groove provided in the base body.

Thus, according to the invention, there is provided, in a setting tool, a spring-biased, locking nose extending in a direction transverse to the setting direction and which, upon the guide tube reaching a predetermined screw-in depth during screwing of the guide tube into the tool base body, becomes engaged in a radial groove provided in the base body, preventing both further screwing-in and unscrewing of the guide tube. When the guide tube needs to be removed, the locking nose should be manually disengaged from the groove by a tool user. An automatic unscrewing of the guide tube from the base body is not any more possible. Thereby, a reliable operational process is insured and, in addition, there is provided a possibility to quickly and simply connect the guide tube with the base body or disconnect the guide tube from the base body.

According to one embodiment of the present invention, the locking nose has a locking rim extending toward a longitudinal axis of the guide tube under an acute angle that opens toward a mouth opening of the guide tube. Thereby, the locking nose can be easily pushed, in a simple way, in the direction toward the base body and, finally, be rotated into the groove, upon the guide tube being rotated to screw the guide tube into the base body. The locking nose is, to some extent, being screwed into the groove, or it can engage in the groove in a bayonet-like manner. The locking nose can already engage in an opening provided for effecting screwing of the guide tube into the tool base body before, finally, engaging in the groove upon further rotation.

According to a further embodiment of the present invention the locking nose forms part of a locking member having a pin element extending radially toward the guide tube and supporting the compression spring supported in a radial recess formed in the guide tube.

In this way, a precise positioning and displacement of the locking nose is insured. Furthermore, the radial arrangement of the compression spring reduces the load applied to the spring during the setting process which, in turn, reduces the spring fatigue and, thereby, the danger of a fatigue fracture.

Advantageously, there is provided an adjusting member formed integrally with the locking member. The adjusting member provides for displacement of the locking member and, thereby, the locking nose against the biasing force of the compression spring. The adjusting member provides for a manual displacement of the locking nose by the tool user. The user can act on the adjusting member either directly or indirectly, with an axially displaceable adjusting sleeve that is slidably supported on the guide tube. The adjusting sleeve is displaced in the longitudinal direction of the guide sleeve in a direction away from the mouth opening of the guide tube. Thereby, a possible laborious inquiry of the position of the adjusting member by the user is avoided. Besides, grasping of the adjusting sleeve is much easier than pressing the adjusting member.

According to an advantageous embodiment of the present invention, the adjusting member has an adjusting rim extending toward a longitudinal axis of the guide tube at an acute angle that opens in a direction away from the mouth opening of the guide tube. When the adjusting sleeve is pushed away from the mouth opening of the guide tube, the sleeve can easily run on the adjusting edge of the adjusting member, displacing the locking nose, by the adjusting member, in the radial direction with respect to the guide tube. In this way, the process of removing the guide tube is further simplified. Preferably, the adjusting sleeve is displaced in the direction away from the mouth opening of the guide tube against a spring-biasing force applied by a further compression spring. This facilitate displacement of the adjusting sleeve to its initial position.

According to a further development of the present invention, there is provided, in the tool base body, guide tube-side means for guiding the locking nose and for limiting radial displacement of the locking nose in a direction away from the guide tube. To this end, the locking nose or the locking member, with which the locking nose is formed as one piece, is slidably displaceably arranged in a slot that lies in the same plane as the central axis of the guide tube. Preferably the locking nose, locking member, and the adjusting member are formed as a one-piece flat-shaped element. In this case, slot and plate planes overlap each other. For limiting the displacement of the adjusting member in a radial direction away from the guide tube, a limiting ring can be provided on the guide tube against which the adjusting member is biased by the compression spring located in a radial recess formed in the guide tube. Instead of a limiting ring, however, another suitable stop can be used for limiting the displacement of the adjusting member in the radial direction away from the guide tube.

The guide tube can be so formed that the fastening elements are pushed into the guide tube from the tube month opening. In this case, the guide tube is completely circumferentially closed over the entire displacement path of a fastening element.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
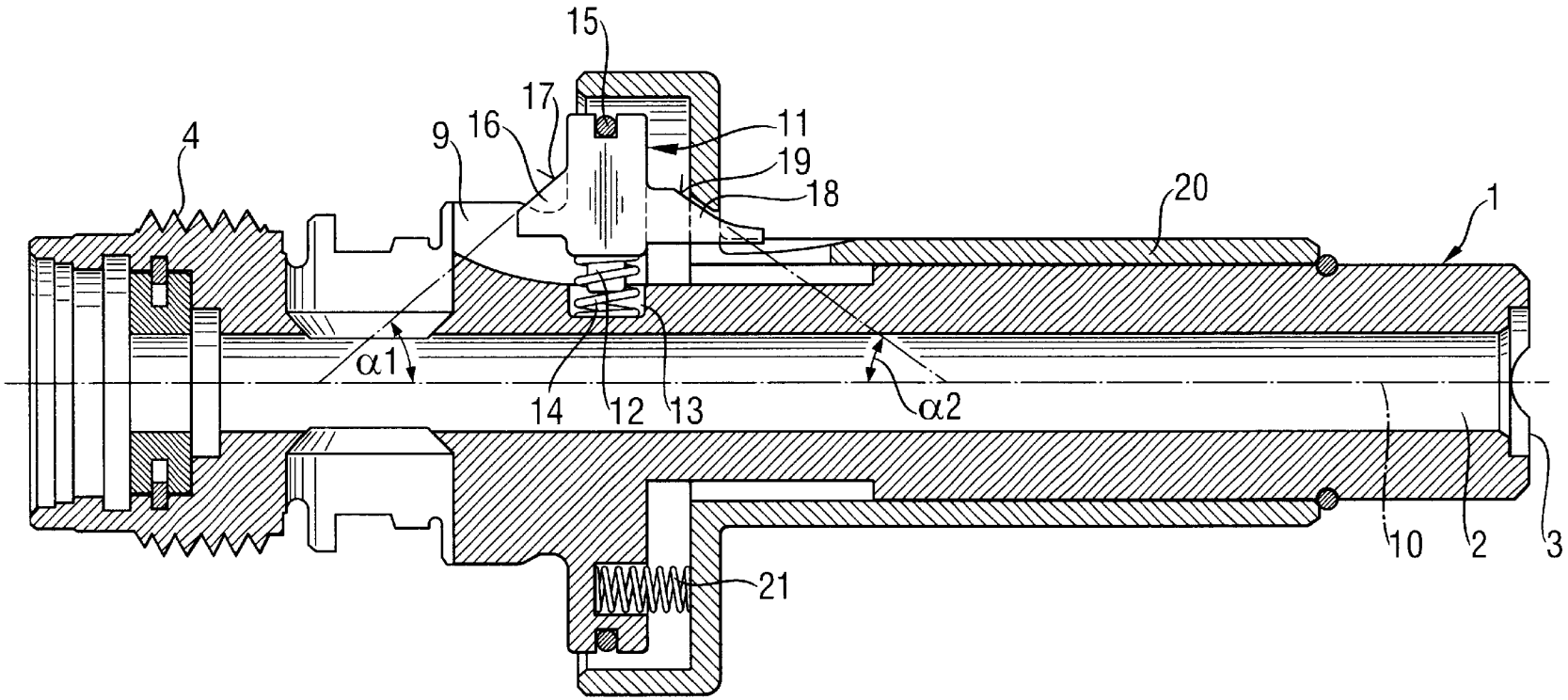
FIG. 1 an axial cross-sectional view of a guide tube of a portable combustion-engined setting tool according to the present invention.
Figure 2:
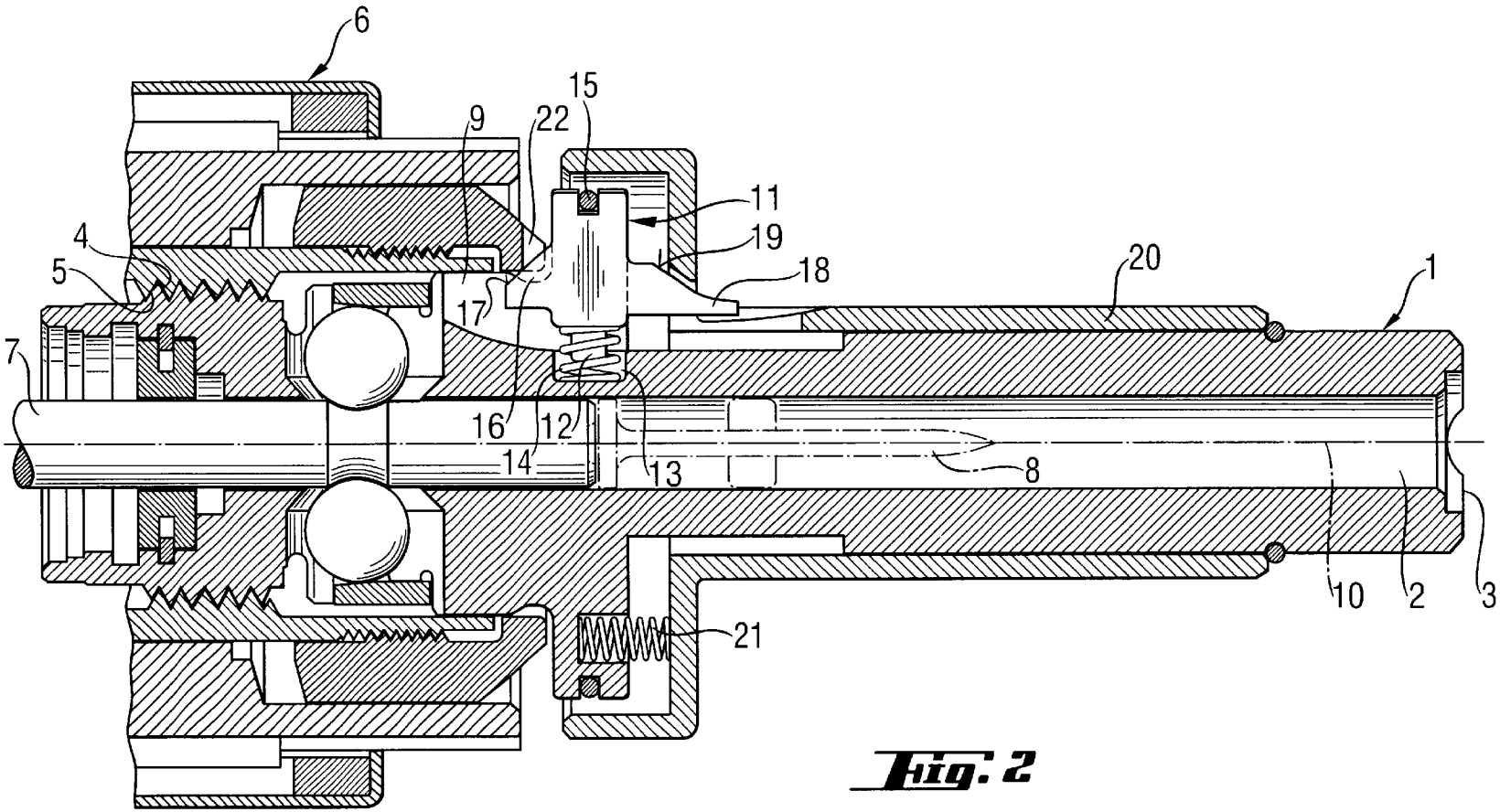
FIG. 2 an axial cross-sectional view showing the guide tube of FIG. 1 in its completely screw-in position on the setting tool.

A guide tube of a portable combustion-engined setting tool according to the present invention and which is shown in FIG. 1 separately, i.e., when it is not yet screwed in a base body of the setting tool, is designated with a reference numeral 1. The guide tube 1 has an inner channel 2 for receiving a to-be-set fastening element (not shown), such as nail, bolt, and the like. The mouth opening of the guide tube 1 is designated with a reference numeral 3. The fastening element is pushed out of the mouth opening at its end opposite the mouth opening 3, the guide tube 1 has an outer thread 4 that cooperates with an inner thread 5, which is provided in the base body 6 of the setting tool, for screwing the guide tube 1 into the base body 6, as shown in FIG. 2. A piston rod 7 projects in a direction toward the mouth opening 3 for pushing the fastening element out of the inner channel 2 and through the mouth opening 3 upon driving movement of a piston (not shown) displaceably arranged in a combustion chamber of the base body 6. For displacing the driving piston, together with the piston rod 7, an air-/fuel gas mixture or an ignitable powder, which is provided in the combustion chamber, is ignited by actuating a trigger (not shown) or an actuation lever, with the pressure generated by combustion displacing the piston. The fastening element is shown in FIG. 2 with dot-dash line and is designated with a reference numeral 8.

As shown in FIG. 1, in the somewhat middle region of the guide tube 1, there is provided a gap 9 that lies in a plan in which a longitudinal axis 10 of the inner channel 2 extends. The gap 9 start at a distance from the inner channel 2 and extends up to the outer circumference of the guide tube 1. In the gap 9, there is located a plate-shaped locking member 11 which is slidably displaceable in a radial direction of the guide tube. The plate-shaped locking member 11 is integrally connected, is formed as one piece, with a pin element 12 likewise extending in the radial direction. The pin element 12 projects into a radial recess 13 formed in the guide tube 1. A helical compression spring 14, which is supported, at one of its end, against the bottom of the radial recess 13 and, at its other end, against the lower edge of the locking member 11, is supported on the pin element 12. The compression spring 14 biases the locking member 11 radially away from the guide tube 1 into its radial end position. The end position of the locking member 11 can be defined, e.g., by a ring 15 that concentrically surrounds the guide tube 1 and is supported thereon.

The locking member 11 is provided with a locking nose 16 that lies in the plane of the locking member 11. The locking nose 16 extends in a direction toward the outer thread 4 and away from the mouth opening 3. The locking nose 16 is provided with a locking rim 17 that extends toward the longitudinal axis 10 of the guide tube at an acute angle $\alpha 1$ that opens toward the mouth opening 3.

An adjusting member 18, which extends in a direction toward the mouth opening, is likewise made integrally with the locking member 11. The adjusting member 18 has an adjusting rim 19 extending toward the longitudinal axis 10 at an angle $\alpha 2$ that opens in a direction away from the mouth opening 3. The adjusting rim 19 provides for displacement of the locking member 11 against a biasing force of the compression spring 14 in a direction toward the guide tube 1. The locking member 11 is displaced when a force is applied to the adjusting member 18 via the adjusting rim 19. The adjusting force can be applied manually, with the setting tool user directly pressing the adjusting member 19, or with the adjusting member 18 being displaced under pressure applied by an adjusting sleeve 20 when the adjusting sleeve 20 is displaced in a direction toward the outer thread 4 and runs on the adjusting edge 19. The adjusting sleeve 20 is arranged coaxially with respect to the guide tube 1 and slides thereon. A compression spring 21 biases the adjusting sleeve 20 in a direction away from the outer thread 4 to the initial position of the adjusting sleeve 20.

FIG. 2 shows a condition in which the guide tube 1 is completely screwed into the base body 6 of the setting tool, with the outer thread 4 being screwed into the inner thread 5 of the base body completely. In this position of the guide tube 1, the locking nose 16 is located in a groove 22 formed in the end surface of the base body 6 adjacent to the guide tube 1. The groove 22 extends from a central opening, which contains the inner thread 5 radially outwardly in a direction toward the mouth opening 3 of the guide tube 1. As it has already been discussed previously, the compression spring 14 biases the locking member 11 radially away from the guide tube 1 and toward the stop ring 15, so that the upper portion of the locking nose 16 lies in the groove 22. The tip of the locking nose 16 can, at that, project into the central opening of the tool base body 6.

Figure 3:
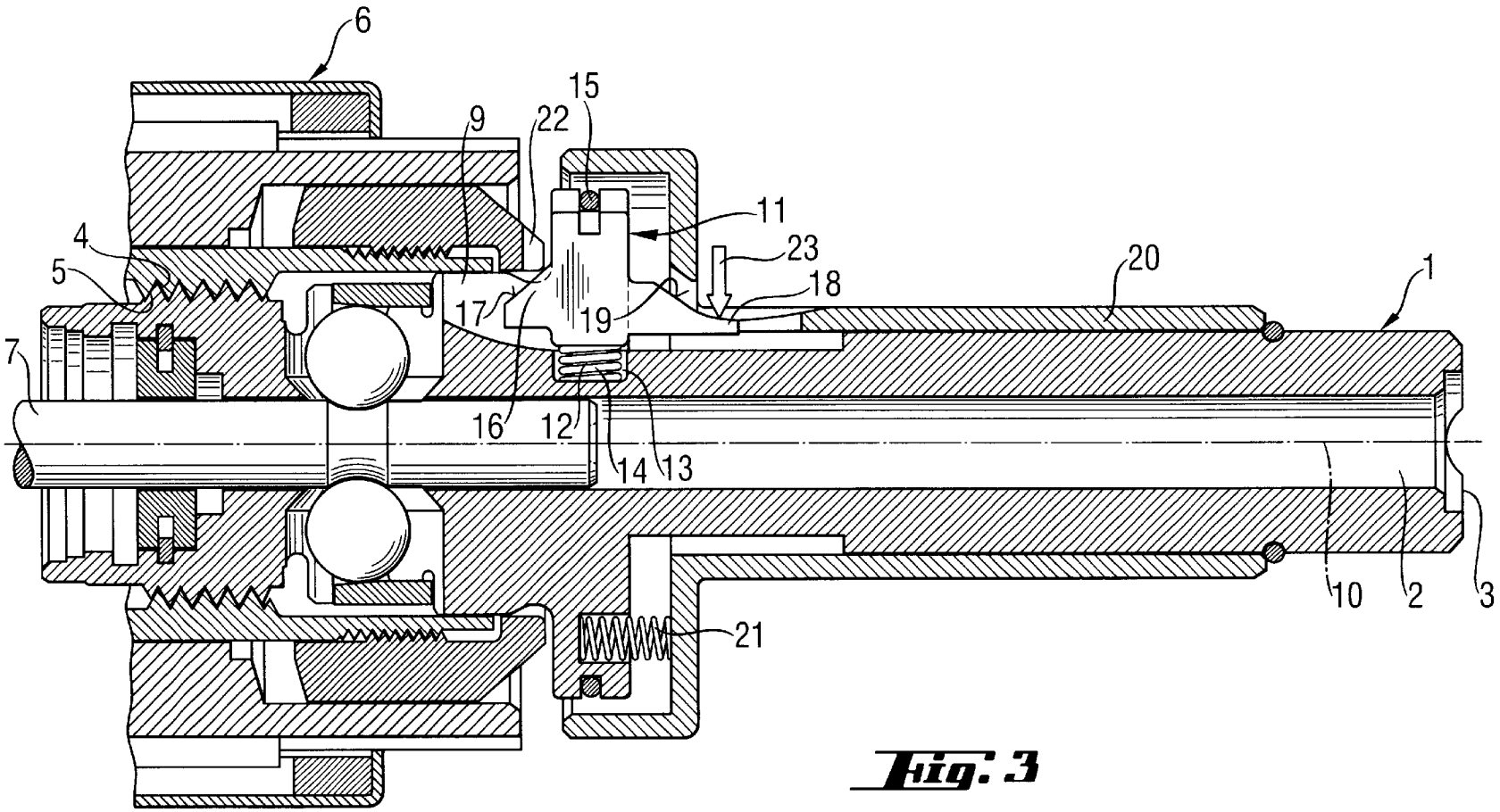
FIG. 3 an axial cross-sectional view showing the guide tube of FIG. 1 in its release position.

FIG. 3 shows a release position of the guide tube 1 in which it is not completely screwed into the base body 6.

Upon a manual actuation of the adjusting member 18, the locking member is displaced radially towards the guide tube 1. The compression spring 14 becomes compressed. The locking nose 16 is located completely outside of the groove 22 and in the central opening of the base body 6. In this position, the guide tube 1 can be rotated relatively to the base body 1 about the central axis 10.

Figure 4:
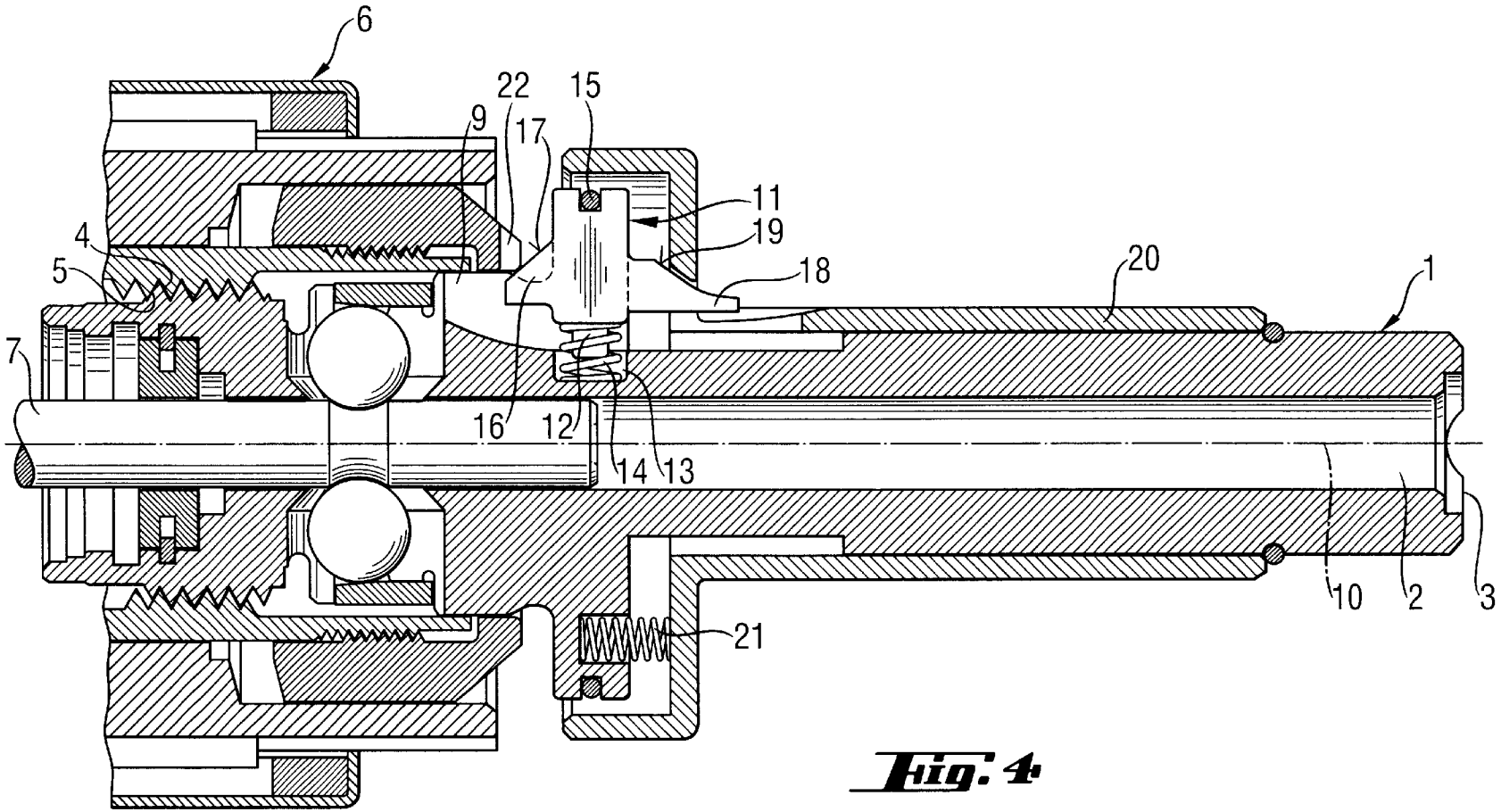
FIG. 4 an cross-sectional view showing the guide tube in its release and unscrewed, as a result of rotation, position.

FIG. 4 shows a condition in which the guide tube 1 has been screwed out of the base body 6 by one turn. The compression spring 14 again biases the locking member 11 against the stop ring 15 radially away from the guide tube 1, and the locking nose 16 is not engaged in the groove 22 any more. In this position, the guide tube 1 can be further screwed out of the base body 6, without the locking member 11 being actuated by the adjusting member 18.

When the guide tube 1 is being screwed into the base body 6, i.e., when the outer thread 4 is screwed in the inner thread 5, the conditions shown in FIGS. 4, 3, and 2, follow each other in the following order. When the locking nose 16 approaches, upon the outer thread 4 being screwed in the inner thread 5, the inner circumferential edge of the central opening of the base body 6, the inner circumferential edge of the central opening run on the locking rim 17 of the locking nose 16 and presses thereby the locking member 11 radially toward the guide tube 1, with the compression spring 14 being compressed. Upon further screwing of the outer thread 4 in the inner thread 5, in a certain angular position of the guide tube 1, the locking nose 16 is located opposite the groove 22, as shown in FIG. 3. In this position of the guide tube 1, the compression spring 14 biases the locking member 11 away from the guide tube 1, and the locking nose 16 engages in the groove 22, locking the guide tube 1 and the base body 6 together. This locking position of the guide tube 1 and the base body 6 cannot be released only by rotation of the guide tube 1 relative to the base body 6, because the plate-shaped locking nose 16 is form-lockingly engaged in the parallel radial groove 22.

Though the present invention was shown and described with references to the preferred embodiment, such is merely illustrative of the present invention and is not to be construed as a limitation thereof, and various modifications to the present invention will be apparent to those skilled in the art. It is, therefore, not intended that the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A portable, combustion-engine setting-tool for fastening elements, comprising a base body (6); a guide tube (1) for fastening elements (8); a piston rod (7) for driving fastening elements out of the guide tube (1); and locking means for lockingly connecting the guide tube (1) with the base body (6), the locking means including a locking nose (16) carried by the guide tube (1); a spring (14) for radially biasing the locking nose (16) away from the guide tube, the locking nose (16) being displaceable toward the guide tube (1) against a biasing force of the spring (14) manually, and a groove (22) provided in the base body (6) and into which the locking nose (16) is radially displaceable.

2. A setting tool according to claim 1, wherein the locking nose (16) has a locking rim (17) extending toward a longitudinal axis (10) of the guide tube (1) under an acute angle (α1) that opens toward a mouth opening (3) of the guide tube (1).

3. A setting tool according to claim 1, wherein the locking nose (16) forms part of a locking member (11) having a pin element (12) extending radially toward the guide tube (1) and supporting the compression spring (14) supported in a radial recess (13) formed in the guide tube (1).

4. A setting tool according to claim 1, wherein the locking means further comprising an adjusting member (18) formed integrally with the locking nose (16) and providing for displacement of the locking nose (16) against a biasing force of the compression spring (14).

5. A setting tool according to claim 4, further comprising an adjusting sleeve (20) supported on the guide tube (1) and axially displaceable there along in a direction away from a mouth opening (3) of the guide tube (1) for displacing the adjusting member (18) in a direction toward the guide tube (1).

6. A setting tool according to claim 5, wherein the adjusting member (18) has an adjusting rim (19) extending toward a longitudinal axis (10) of the guide tube (10) at an acute angle (α2) that opens in a direction away from the mouth opening (3) of the guide tube (1).

7. A setting tool according to claim 6, further comprising a further spring (21) for biasing the adjusting sleeve (20) in a direction toward the mouth opening (3) of the guide tube (1).

8. A setting tool according to claim 1, further comprising means (9, 15) for guiding the locking nose (16) and for limiting a radial displacement of the locking nose (16) away from the guide tube.

9. A setting tool according to claim 1, further comprising thread means (4, 5) for connecting the guide tube (1) with the base body (6).

10. A setting tool according to claim 1, wherein the guide tube (1) is completely circumferentially closed over a displacement path of a fastening element (8).

* * * * *